US005697839A

United States Patent [19]

Chen et al.

[11] Patent Number: 5,697,839

[45] Date of Patent: Dec. 16, 1997

[54] VENTILATION HOOD FOR WET-CLEAN PROCESS CHAMBER

[75] Inventors: Ying-Hsiang Chen, Hsin-chu; Wei-Yao Chien, Nan Tou; Deh-Hsiung Peng; Yung-Mao Hsu, both of Hsin-Chu, all of Taiwan

[73] Assignee: Taiwan Semiconductor Manufacturing Company Ltd., Hsin-chu, Taiwan

[21] Appl. No.: 679,912

[22] Filed: Jul. 15, 1996

[51] Int. Cl.[6] ..... B08B 15/02

[52] U.S. Cl. ..... 454/67; 15/249.2

[58] Field of Search ..... 454/44, 67; 15/249.2, 15/246, 227, 104.068, 104.066, 104.05, 257.1, 257.4

[56] References Cited

U.S. PATENT DOCUMENTS

| | | | |
|---|---|---|---|
| 2,948,354 | 8/1960 | Hammink | 15/246 X |
| 4,809,391 | 3/1989 | Soldatovic | 15/301 |
| 4,928,440 | 5/1990 | Hughes . | |
| 5,245,763 | 9/1993 | Neikter | 34/22 |
| 5,309,650 | 5/1994 | Josefsson et al. | 34/493 |
| 5,338,248 | 8/1994 | Sumrack | 454/49 |
| 5,344,615 | 9/1994 | Yanagi et al. | 422/170 |

OTHER PUBLICATIONS

S.Wolf, "Silicon Processing For The VLSI Era–Vol. 2", Lattice Press, Sunset Beach, CA. 1990, pp. 516–518.

*Primary Examiner*—Harold Joyce

*Attorney, Agent, or Firm*—George O. Saile; Stephen B. Ackerman

[57] ABSTRACT

An apparatus for venting hazardous effluents from process equipment used in the manufacture of semiconductors, which is part of a larger ventilating system, is a "see-thru" transparent chamber which performs the function of a hood, and can be mounted on any one of the conventional semiconductor processing equipment. Because it is transparent, the operator can easily determine when to clean the hood. This is important from the point of view of not exposing the work piece in the processing equipment to effluent contaminants. Usually, the effluents are hazardous to health. Hence, the apparatus is equipped with a pair of gloves which are an integral part of an access door to the hood, and is used to manipulate remotely cleaning tools that are kept inside said hood: remote in the sense that the operator is never exposed to the hazardous effluents inside the chamber hood, and yet is easily capable of using the cleaning tools inside the hood by means of the pair gloves that are an integral part of the hood. The throughput of the manufacturing line is favorably affected since cleaning can be accomplished without stopping the process taking place in the semiconductor manufacturing line.

31 Claims, 3 Drawing Sheets

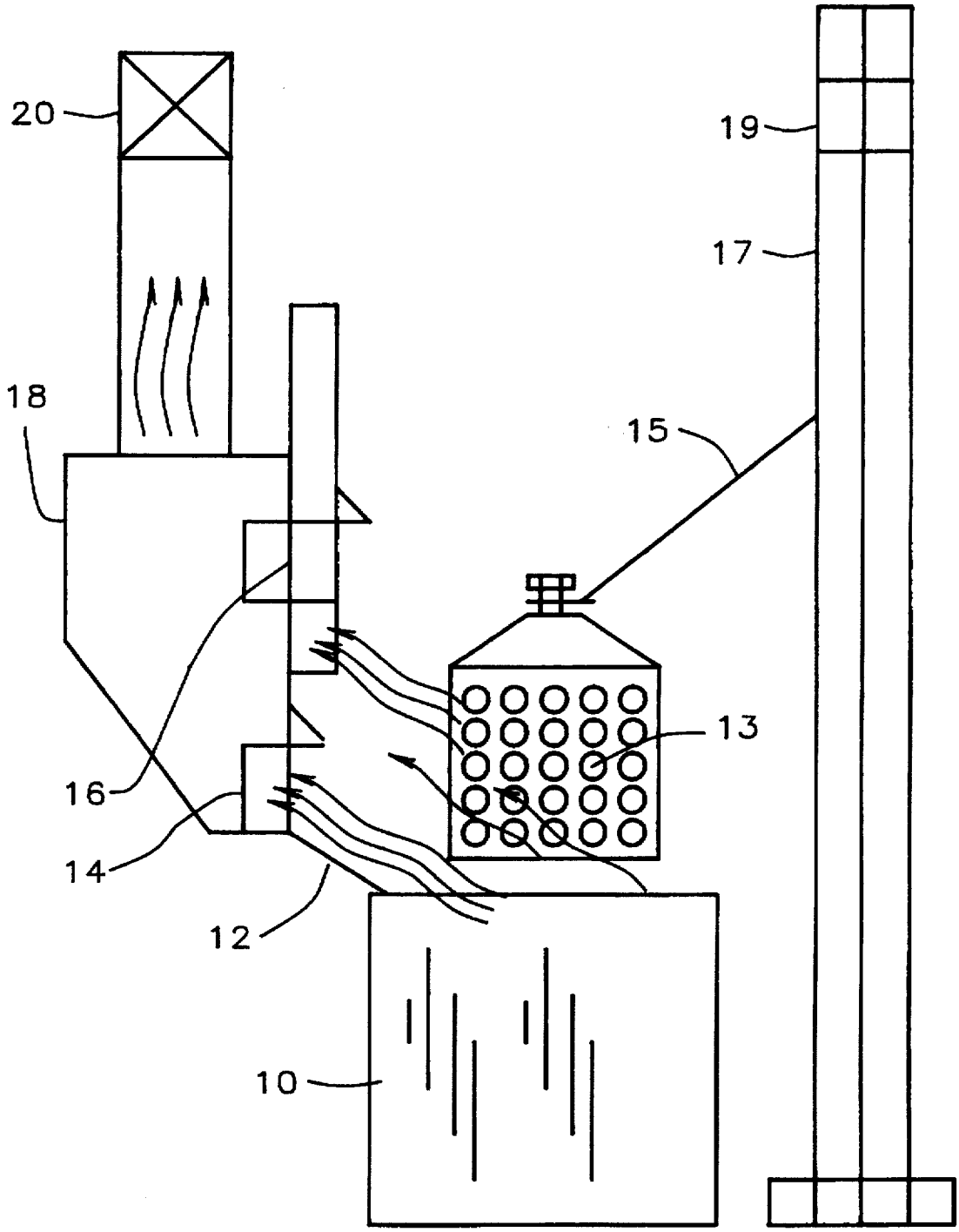
FIG. 1 – Prior Art

VENTILATION HOOD FOR WET-CLEAN PROCESS CHAMBER

BACKGROUND OF THE INVENTION

1. Field of the Invention

The invention relates generally to methods and apparatus utilized for the purpose of venting hazardous vapors and fumes away from workers and work place, and in particular, to a new ventilation hood which is used with reactors that generate contaminant and pollutant matter in the manufacture of semiconductor devices.

2. Description of the Related Art

In the industry at large, there is more and more of a keen awareness of the contaminants and pollutants that are being generated by various manufacturing processes and released into the environment. Manufacturers attempt to follow guidelines developed by organizations such as OSHA, the EPA and the DNR (Department of Natural Resources) that dictate the maximum amount of undesirable substances that may be discharged into the environment outside the manufacturing plant. At the same time, there is the concern of these undesirable substances being released into the work place within the manufacturing plant where they can create health problems for the working personnel. Furthermore, same contaminants, if not directed and controlled in their effluence from various process sectors, such as plating tanks, wafer cleaning bins, or semiconductor reactors, can cause defects on the manufactured products. Of course, the most effective way to deal with contaminants is to eliminate the source of the contaminant. However, if that can not be done and once generated, the control of the flow of contaminant particulate is important both from the point of protecting the working personnel from harmful effects, as well as manufacturing defect free products.

Sources for contaminants such as smoke, chemical vapors, particulate matter, and others are many and varied. Prior art teaches different methods for directing and controlling the undesirable vapors and fumes depending upon a particular application. For example, U.S. Pat. No. 5,309,650 proposes blowing air in a paint baking oven to ventilate solvents and/or resins which evaporate during the paint baking process. According to this teaching, the ventilation air is directed toward the center of the paint baking oven where it is exhausted at a rate proportional to the rate at which the ventilation air is introduced into the paint baking oven. In this case, it is said that removing the solvent and/or resin laden air from the paint baking oven results in a more desirable finish on the component being baked.

In U.S. Pat. No. 5,245,763 an apparatus and method for removing solvent vapors from a vehicle body in a paint spray booth utilizes an air supply hood positioned adjacent a window opening of the vehicle body to supply air to the interior of the body. an exhaust hood positioned at a window opening of the body on an opposite side thereof sucks off solvent vapors. In this manner, the solvent vapors, which constitute a health hazard, are removed from the interior of the vehicle before being manually inspected for the quality of the surface layer of the vehicle. In addition, the exhaust hood so provided also helps in removing other paint and dust particles, thereby eliminating their being deposited on painted surface and marring the finish.

Ventilating hoods are used especially in the plating industry where noxious fluids in tanks need to be vented. A ventilating system for ventilating a process tank is proposed in U.S. Pat. No. 5,338,248. The hoods are designed such that judiciously positioned slot openings are covered and uncovered automatically to provide additional venting only as needed. Because air is not used continuously, the reduction in the overall-all amount of air used results in the reduction in the overall sizing and cost of the ventilation system.

Another technique for reducing the amount of air (or dry nitrogen, as is commonly used) in a ventilating system is to seal the working space under a hood and recirculate the ambient environment over and over again while at the same time passing it over a cleaning filter. Such as system is proposed in U.S. Pat. No. 5,344,615. In this manner, the contaminants are captured each time the ambient medium is passed through the filter and a super clean environment is achieved under the hood.

While the aforesaid proposals address the problems of controlling the flow of contaminants or pollutants and the cleanliness of the environment under a hood, or the economical ways in which a ventilating system may be operated, none of them address the problems associated with the interaction of operators with said systems. For example, in the ventilating system shown in FIG. 1, which is extracted from U.S. Pat. No. 5,338,248 mentioned above, the processing tank (10), such as a plating tank, is completely open to its immediate environment. The work pieces that are to be plated are carried in carrier (13) and placed into said plating tank (10), and afterwards lifted out by means of a forked arm (15) which rides up and down on a column (17) which is a part of a crane (19) that is used to transport the carrier (15) between plating and cleaning tanks. For brevity, and simplicity, other tanks are not shown here. The important point here is that the effluent fumes emanating from the plating tank are sucked into hood (18) by means of a deflector (12) through slot (14) into hood (18). They are then vented away into a central exhaust system (20) as shown in FIG. 1 of prior art. Slot (16) is the one that is judiciously positioned to provide additional venting automatically and as needed. However, it will be appreciated that should the whole tank be covered by a hood, the environment around the processing tank would be much less hazardous to health of personnel operating the plating line.

The effluent particles, or pollutants that are found in semiconductor manufacturing lines are classified as particulate or film, and they determine to some extent the nature of cleaning that is needed inside a ventilation hood. As S. Wolf describes in his book S. Wolf, "Silicon Processing for the VLSI Era," vol. 2, Lattice Press, Sunset Beach, Calif., 1990, pp. 516–518, particulate matter are any bits of material that have readily definable boundaries. In a semiconductor manufacturing environment, particulate sources include silicon dust, quartz dust, atmospheric dust, and particles originating from clean run personnel and processing equipment. Examples of film contaminants are solvent residues, such as acetone, isopropyl alcohol, methyl alcohol, xylene, photoresist developer residues from dissolved photoresist in the developer, oil films introduced through improperly filtered air or gas lines, and metallic etchant or deist stripper baths. It should be noted that chemical cleaning and photoresist stripping operations used to remove film contamination can also become sources of particulate contamination.

Chemical cleaning is used to remove chemically bonded films from wafer surfaces, and as practiced in the art, a series of acid and rinse baths are used for this purpose. The hoods place over these baths are conventionally opaque and metal and the operators must lift them up for inspection and lean them periodically with certain implements. In the process of doing so, metal surfaces are easily gouged forming particulate contaminants. Furthermore, the operators are exposed to toxic fumes unnecessarily. Photoresist stripping, on the other hand, requires different techniques of removal depending upon the particular process step in the manufacture of semiconductor substrates. Thus, organic strippers are used to remove photoresist after patterning metallized substrates. Here, resist removal is performed by breaking down the structure of the resist layer, with phenol-based strippers. Wet inorganic oxidizing-type strippers such as solutions of sulfuric acid $H_2SO_4$ and an oxidant and heated to approximately 125° C. are used to remove resist from non-metallized wafers. Resist removal is also accomplished by dry etching using oxygen plasmas in a plasma etching equipment. In each one of these operation, the flow of effluent material emanating from these processes must be controlled and directed away from the work piece and the work environment for safe and defect free product manufacturing.

As will be appreciated by workers in the field, what is needed, therefore, is a means by which various process equipment in a manufacturing line can be fitted with a chamber that has the following attributes: a)performs the function of a hood; b) can easily be mounted on to various processing tanks; c) directs and vents harmful effluents to an exhaust, d) monitors the flow of the effluent; e) is made out of a translucent, that is, transparent material; f) is equipped with remote gloves: and g) has an easily accessible door.

It is described in more detail later on that the transparent walls provide an unobstructed view of the interior of the hooded chamber until such time that insides of the walls must be cleaned of the collecting particulate and/or film contaminants. The operator can now clean the walls of the hood by inserting his arms and hands into a pair of remote gloves that are constructed as an integral part of one of the walls of the chamber. It is important that the walls be cleaned periodically so that the particulate or film contaminants would not "flake off" and fall back on the work piece in the processing equipment below. It will be noted that the operator is protected from the hazards of the effluents in the chamber, and furthermore, in most cases, he or she is able to accomplish the cleaning without having to stop the ongoing manufacturing process and without affecting the throughput of the line.

SUMMARY OF THE INVENTION

It is therefore an object of this invention to provide an apparatus for controlling and directing the effluents from a process equipment to a ventilating system in general, and into a central exhaust system in particular, in the manufacture of semiconductor devices.

It is another object of this invention to provide a method for reducing the exposure of operators to harmful effluents emanating from process equipment.

It is still another object of the present invention to provide a method for reducing defects in semiconductor products by enabling operators to clean process hood chambers more effectively.

It is a further object of the present invention to improve the throughput of process operations by enabling the cleaning of chemical hoods remotely, without stopping a process that is underway.

These objects are achieved by providing a chamber apparatus that performs the function of a hood. It is easily mountable over different types of process equipment. The chamber vents harmful effluents into a central exhaust system and is equipped with monitoring equipment to control the flow of the effluents. Preferably the chamber is made out of translucent material so that the operator has undiminished view of the interior of the chamber. In a less preferred embodiment, only the door to the chamber is translucent, that is, transparent. Further, said door is also equipped with sealed remote gloves which can be worn in situ by the operator so as to be able to clean the interior of the chamber hood without being influenced by the effects of the harmful effluents, and, if need be, without stopping the process that is underway.

BRIEF DESCRIPTION OF THE DRAWINGS

The objects and features of this invention will become apparent more readily from a reading of the detailed description in conjunction with the drawings that follow:

FIG. 1 is an isometric view showing a prior art hood for exhausting fumes such as from cleaning, plating or other processing tanks.

DESCRIPTION OF THE PREFERRED EMBODIMENTS

Figure 2A:
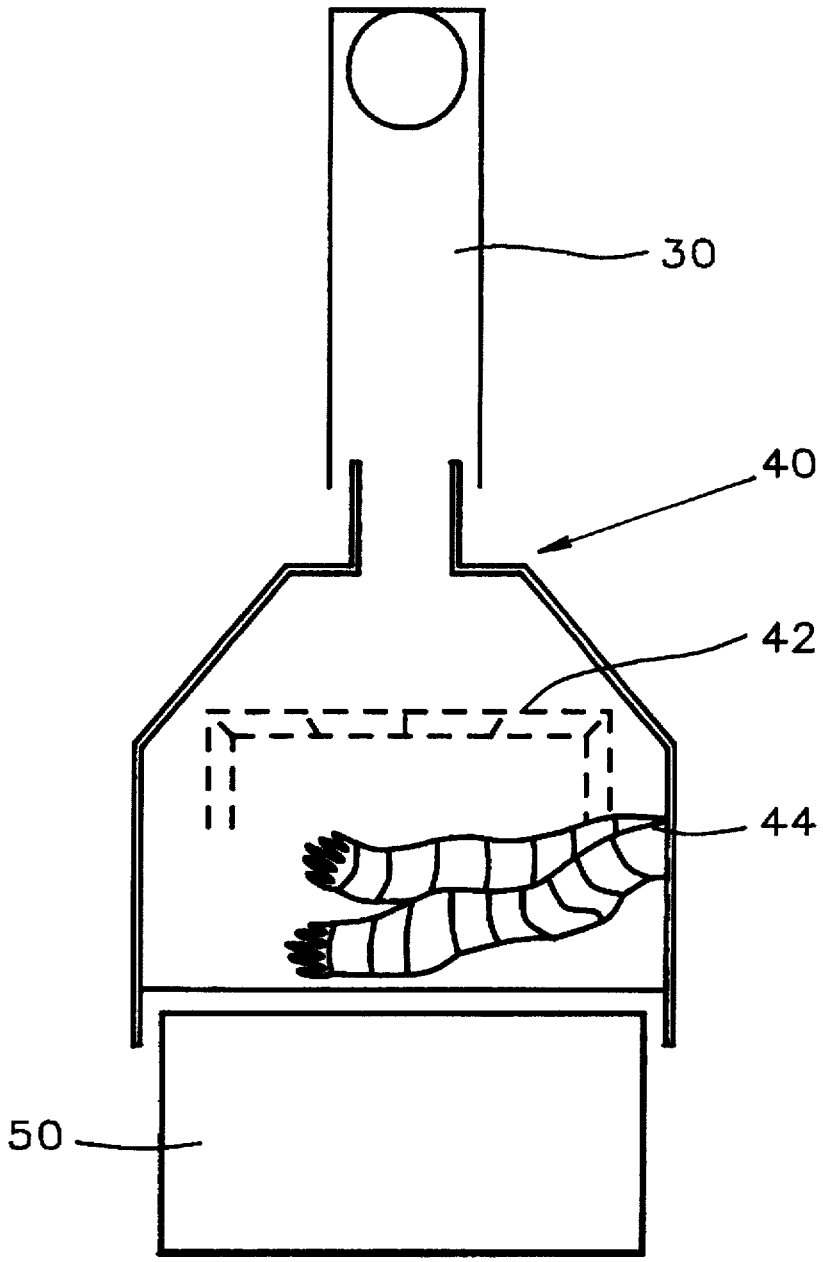
FIG. 2*a* is a schematic drawing showing side-view of the remote gloves used in the ventilation hood of the present invention.
Figure 2B:
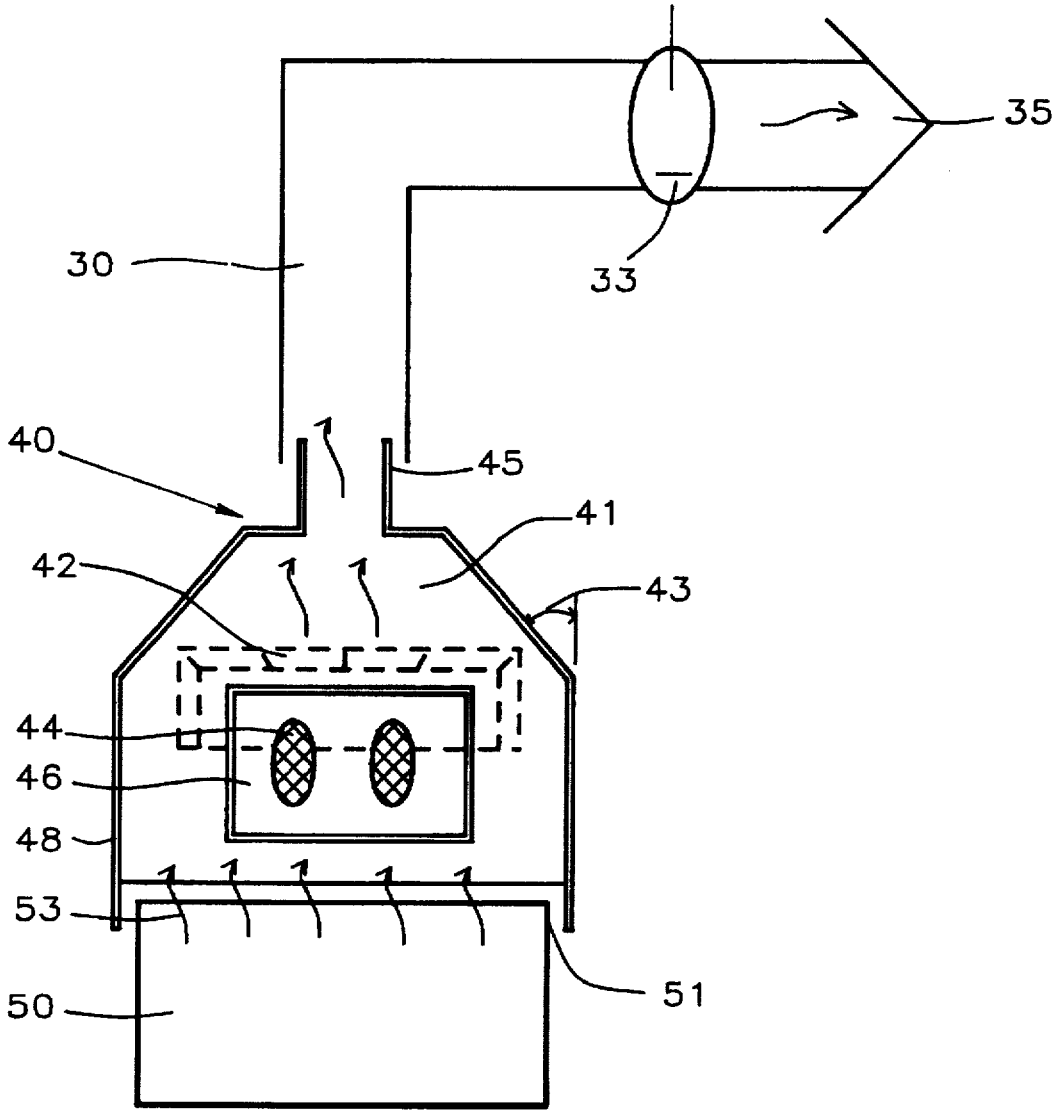
FIG. 2*b* is a schematic drawing showing the frontal view of the door and the glove assembly according to the present invention.

Referring now to the drawings, more particularly to FIGS. 2*a* and 2*b*, there is shown a ventilation system according to this invention. The systems comprises exhaust ducting (30), hood apparatus (40) and process equipment (50). It will be observed that as is not the case with conventional hoods of FIG. 1, the hood apparatus of this invention is mounted directly over process equipment(50). Furthermore, said hood (40) is not necessarily of rectangular shape as in FIG. 1.

The flow of effluents (53) from said process equipment (50) is directed and controlled by suction provided by a central exhaust system (35), which itself is not significant to the invention, and therefore not described here in order not to unnecessarily obscure the present invention. The suction is easily monitored by means of a manometer or pressure gauge (33) placed near the exit of the exhaust ducting as shown in FIG. 2*b*. In the preferred mode, the pressure indicated by said gauge (33) should read less than on atmosphere, between about $10^6$ Pascal to $3\times10^6$ Pa. Because of the positive ambient pressure relative to the negative pressure inside hood (40), it is assured that the effluents emanating from the process equipment will not escape into the ambient environment, and therefore, it is not necessary to seal said hood onto process equipment (50). However, when vacuum is required such as during sputter cleaning of wafers, it is preferred that apron (48) of said hood (40) is sealed against the upper edge (51) of sputter equipment (50). It will be appreciated that hood (40) is not limited to any one particular process equipment and can be used in conjunction with different types of equipment. Furthermore, the properties, such as density, of effluents emanated by different processes will be different, and the pressure differential required between exhaust (35) and effluents (53) at equipment (50) will vary accordingly.

Hood (40) is preferably made out of a translucent or transparent material such as acrylicpoly or polymethyl methacrylate which are known for their crystal clarity, strength and weatherability (See "Mark's Standard Handbook for Mechanical Engineers," edited by Eugene A. Avallone and Theodore Baumeister III, Ninth Edition, 1987, p.6–173).

Transparency is preferred to provide the operator clear view of the interior of said hood. In this manner, the operator can determine when it is necessary to clean the hood of effluent material, particulate or film, collecting on the inside walls (41) shown in FIG. 2b. Usually, film forming effluents will require better visibility through the hood material than the particulate effluents since the latter do not have the tendency to stick together and spread like the former does. Also, films will generally require more frequent cleaning than the particulates. In either case, as described here, cleaning can be accomplished very easily and as often as needed according to this invention. Thus, the funnel shape of hood (40) shown in FIGS. 2a and 2b makes it easier to reach the inside walls (41). It is preferred that the inclination of walls (41) is between about 30° and 60°.

Cleaning of the interior of hood (40) is accomplished by means of gloves (44) which are affixed to a removable door panel (46) shown in FIG. 2b. Said gloves are made out of flexible material such as rubber and are large enough to comfortably accommodate the arms and hands of an operator. Gloves (44) are folded like bellows and are extendible so that different operators with different am lengths can use them easily. It will be obvious to those skilled in the art that additional gloves on additional door panels can be installed on the other side-walls of a rectangular hood (40)—or in other sectors of a cylindrical hood—as needed depending upon the dimensions of said hood mounted on process equipment (50). Having a plurality of pair of said gloves on additional walls will facilitate the complete cleaning of all walls (41) in hood (40), unless, the dimensions of said hood are small enough that all walls can be reached by one pair of gloves on one wall only. The door panel(s) (46) are attached to edges of opening(s) on walls of hood (40) in any number of conventional ways such as using hinges, latches, cams, or other means known in the art.

In the preferred embodiment of the present invention, the contaminants that are wiped or scraped off the walls of hood (40) are placed in a reservoir or trap (42) shown in FIG. 2b. As will be described presently, said reservoir performs a dual function in hood (40). Firstly, it is a place reserved for keeping tools and other implements that are needed for the cleaning operation inside said hood. Secondly, it also provides a place for "dumping" temporarily any material cleaned and scraped off the walls of hood (40). Preferably, said reservoir (42) has a dish shape top to catch falling flakes from wall (41), and a flat shelf below to store said tools. Reservoir (42) is constructed centrally with respect to hood chamber (40) and with space around it to accommodate the movement of hand in glove (44) in the space above said reservoir to affect the cleaning of wall (41). An added advantage of inclined wall (41) is realized here in that the inclination urges the effluent particles to fall into reservoir (42) rather than straight down into process equipment (50) below as it would be the case had the ceiling of hood (40) been flat as opposed to being inclined. Depending upon the particular process taking place in process equipment (50), the scrapings and wiped material from walls of said hood is either placed and secured in reservoir (42) by means of gloves (44), or released into hood exhaust port (45) shown in FIG. 2b.

The embodiments described of the invention heretofore gives the operator complete control over the ventilation of effluents that emanate from any process equipment, such as depicted in FIGS. 2a and 2b. The operator is totally out of the influence of toxic and other contaminants by protection provided by hood (40) sealed on to process equipment (50). He or she is capable of monitoring visually the conditions in said hood and cleaning it periodically or as needed by or without stopping the process that is underway. This is accomplished by means of remote gloves (44) that are an integral part of access door (46) of said hood. More thorough cleaning is accomplished by completely removing the access door. Finally, the flow of effluents (53) is controlled by varying the pressure differential between central exhaust (35) and process equipment (50). The apparatus is preferably and best suited for wet-clean processes in the manufacture of semiconductors.

While the invention has been particularly shown and described with reference to the preferred embodiments thereof, it will be understood by those skilled in the art that various changes in form and details may be made without departing from the spirit and scope of the invention.

What is claimed is:

1. An apparatus for venting effluents from process equipment comprising:

an exhaust system;

means to control the flow of effluents;

a ventilation hood;

means to observe said effluents in said hood;

means to direct the flow of said effluents;

means to catch said effluents;

means to store cleaning tools inside said hood;

an access door;

a pair of gloves attached to said door; and means to clean inside of said hood.

2. The apparatus of claim 1, wherein said exhaust system is a central system.

3. The apparatus of claim 1, wherein said means to control the flow of effluents is a vacuum gauge.

4. The apparatus of claim 3, wherein said vacuum gauge is placed at the exit near the exhaust system.

5. The apparatus of claim 3, wherein said vacuum gauge should read less than one atmospheric pressure between about $10^6$ Pa to $3\times10^6$ Pa.

6. The apparatus of claim 1, wherein said ventilation hood is connected to said exhaust system.

7. The apparatus of claim 1, wherein said means to observe the flow of effluents is a transparent material.

8. The apparatus of claim 7, wherein said transparent material is a acrypoly.

9. The apparatus of claim 1, wherein said means to direct the flow of effluents is inclined ceiling of said ventilation hood.

10. The apparatus of claim 9, wherein said ceiling is inclined at an angle between about 30° to 60°.

11. The apparatus of claim 1, wherein said means to catch effluents is a dish shaped reservoir.

12. The a apparatus of claim 11, wherein said dish shaped reservoir consists of acrypoly.

13. The apparatus of claim 1, wherein said means to store cleaning tools is a shelf attached to said reservoir.

14. The apparatus of claim 11, wherein said reservoir is positioned centrally with respect to inside of said hood.

15. The apparatus of claim 14, wherein said reservoir has a clearance of between about 28 cm to 32 cm between it and the nearest wall of said hood.

16. The apparatus of claim 1, wherein said access door consists of acrypoly.

17. The apparatus of claim 16, wherein said access door is removable from said hood.

18. The apparatus of claim 1, wherein said pair of gloves are removable from said door.

19. The apparatus of claim 18, wherein said gloves are flexible and extendible.

20. The apparatus of claim 18, wherein said means to clean inside of said hood is said tools.

21. A method for venting effluents from process comprising the steps of:

providing a ventilation hood connected to a central exhaust system;

providing a process equipment;

mounting said hood onto said process equipment;

mounting gloves on a door of said hood;

mounting said door onto said hood;

setting effluent flow parameters;

storing cleaning tools within said hood;

manipulating said cleaning tools with said gloves;

to dislodge effluent particles from walls of said hood; and storing said tools.

22. The method of claim 21, wherein said ventilation hood consists of transparent material.

23. The method of claim 21, wherein said door consists of transparent material.

24. The method of claim 21, wherein said gloves are sealed against said door.

25. The method of claim 21, wherein said door is sealed against an opening to accept said door on said hood.

26. The method of claim 21, wherein said flow parameter is set by means of a vacuum gauge.

27. The method of claim 26, wherein said gauge is placed near the exit to central exhaust system.

28. The method of claim 21, wherein said gloves are flexible and extendible.

29. The method of claim 21, wherein said gloves reach ceiling and adjacent walls of said hood.

30. The method of claim 21, wherein said effluent particles are dislodged from said ceiling and walls by said cleaning tools.

31. The method of claim 21, wherein said tools are stored inside said hood.

* * * * *